US008348215B1

(12) United States Patent
Smith

(10) Patent No.: US 8,348,215 B1
(45) Date of Patent: Jan. 8, 2013

(54) SYSTEM FOR RAISING AND LOWERING CEILING FANS AND LIGHT FIXTURES

(76) Inventor: Christopher A. Smith, Garland, TX (US)

( * ) Notice: Subject to any disclaimer, the term of this patent is extended or adjusted under 35 U.S.C. 154(b) by 279 days.

(21) Appl. No.: 12/914,744

(22) Filed: Oct. 28, 2010

(51) Int. Cl.
*A47H 1/10* (2006.01)

(52) U.S. Cl. ..... 248/329; 248/321; 242/390.8

(58) Field of Classification Search ..... 248/329, 248/328, 327, 320, 342, 343, 344, 214, 321; 416/244 R, 246; 362/405, 147; 254/268, 254/269, 270, 275, 334; 242/390.8, 390.9
See application file for complete search history.

(56) References Cited

U.S. PATENT DOCUMENTS

D246,286 S 11/1977 Moore
4,316,238 A 2/1982 Booty et al.
5,105,349 A * 4/1992 Falls et al. ..... 362/405
5,420,772 A * 5/1995 Evans ..... 362/386
5,556,195 A 9/1996 Glebe
5,615,855 A * 4/1997 Marue et al. ..... 248/405
5,762,282 A * 6/1998 Wolner ..... 242/390.8
6,443,702 B1 9/2002 Ross
6,520,484 B1 * 2/2003 Shimizu et al. ..... 254/276
7,160,148 B2 1/2007 Kerr

* cited by examiner

*Primary Examiner* — Terrell McKinnon
*Assistant Examiner* — Michael McDuffie

(57) ABSTRACT

A system for raising and lowering a ceiling fixture featuring a reel box with a cable reel and cable, and a motor connected to the cable reel. The cable extends out of the reel box and attaches to a ceiling fixture. The motor rotates the cable reel to wind and unwind the cable. A hollow female cone is connected below the reel box. The cable passes through the female cone. A male cone is attached to the cable below the female cone. The male cone has is adapted to fit inside the female cone. Electrical contact rings are disposed on the inner surface of the female cone for house wiring and the outer surface of the male cone for fixture wiring. When the male cone is in the female cone, the electrical contact rings operatively connect.

12 Claims, 6 Drawing Sheets

SYSTEM FOR RAISING AND LOWERING CEILING FANS AND LIGHT FIXTURES

FIELD OF THE INVENTION

The present invention is directed to a motor and reel system for ceiling fans and ceiling light fixtures that allows fans and fixtures to be lowered to near the ground surface for cleaning purposes.

BACKGROUND OF THE INVENTION

Using ladders can be extremely dangerous. Many individuals have fallen from ladders when changing light bulbs or cleaning ceiling fans. And, in some homes, the ceilings are so high it is almost impossible to reach ceiling fans and light bulbs with traditional ladders. The present invention features a novel system for raising and lowering ceiling fans and ceiling lights, allowing for easy, safe, and ladder-free cleaning.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a system for raising and lowering ceiling fixtures (e.g., ceiling fans and ceiling lights), allowing for easy, safe, and ladder-free cleaning. The system may comprise a mounting rail for mounting in between joists of a ceiling, the mounting rail comprises a first telescopic rail and a second telescopic rail, the first telescopic rail is telescopically received in the second telescopic rail; a rail track disposed on a bottom surface of the second telescopic rail; a reel box slidably disposed on the rail track via a reel box flange, wherein a cable reel is disposed in the reel box and a cable is wrapped around the cable reel, a second end of the cable extends downwardly out of a bottom of the reel box, the second end of the cable is for attaching to a ceiling fixture; and a motor slidably disposed on the rail track via a motor flange, the motor is operatively connected to the cable reel via a coupling, the motor functions to rotate the cable reel in a first direction and a second direction effectively moving ceiling fixture attached to the second end of the cable upwardly toward the ceiling and downwardly toward a ground surface, respectively.

The system may further comprise a female cone positioned below the reel box and connected to the reel box via an attachment means, the female cone is generally hollow with an inner cavity, a first end, and a second end, the second end being open, the first end having a smaller diameter compared to the second end, the first end faces the reel box, the cable passes through the first end of the female cone and further through the second end of the female cone; a male cone attached to the cable near the second end, the male cone is positioned below the female cone, the male cone has a first end and a second end, the first end having a smaller diameter compared to the second end, the first end faces the female cone, the male cone is adapted to snugly fit inside the inner cavity of the female cone; a first electrical contact ring disposed on an inner surface of the female cone and a second electrical contact ring disposed on an outer surface of the male cone, the first electrical contact ring is adapted to be operatively connected to house wiring and the second electrical contact ring is adapted to be operatively connected to wiring of the ceiling fixture, the electrical contact rings operatively connect when the male cone is snugly housed in the female cone; and a swivel pulley disposed in the reel box, the swivel pulley engages the cable, the swivel pulley functions to direct the cable through the bottom of the reel box.

The system may further comprise either (1) a first micro switch is disposed on the swivel pulley and a cable stop disposed on the cable between the swivel pulley and the male cone, the cable stop is adapted to activate the first micro switch of the swivel pulley when the cable is rotated in the first direction such that the cable stop engages the first micro switch, when the first micro switch is activated the first micro switch causes the motor to stop rotating the cable reel in the first direction; or (2) a second micro switch comprising a first half switch disposed on the inner surface of the female cone and a second half switch disposed on the outer surface of the male cone, the second micro switch is activated when the first half switch engages the second half switch, when the second micro switch is activated the second micro switch causes the motor to stop rotating the cable reel in the first direction, or (3) both the first micro switch and the second micro switch.

In some embodiments, a mounting tab is disposed on an outer ends the first telescopic rail or the second telescopic rail, the mounting tabs allow for attachment of the respective telescopic rails to joists in a ceiling. In some embodiments, the motor flange is a U-channel flange. In some embodiments, the reel box flange is a U-channel flange. In some embodiments, the cable stop is constructed in a football-shape. In some embodiments, the placement of the cable stop is adjustable. In some embodiments, the attachment means is a pair of slide rails attached to sides of the reel box, the slide rails allow positioning of the female cone to be adjusted. In some embodiments, the slide rails each comprise a shaft with a center slot. In some embodiments, bolts connect the female cone to the center slots of the slide rails, the bolts can slide up and down within the center slots of the slide rails. In some embodiments, the cable passes through a first cone channel disposed in the first end of the female cone and further through the open second end of the female cone. In some embodiments, system further comprises a remote control functioning to remotely control the motor, the remote control functions to cause the motor to rotate the cable reel in the first direction or the second direction.

DESCRIPTION OF PREFERRED EMBODIMENTS

Referring now to FIGS. 1-5, the present invention features a novel system 100 for raising and lowering ceiling fans and ceiling lights, allowing for easy, safe, and ladder-free cleaning.

Figure 1:
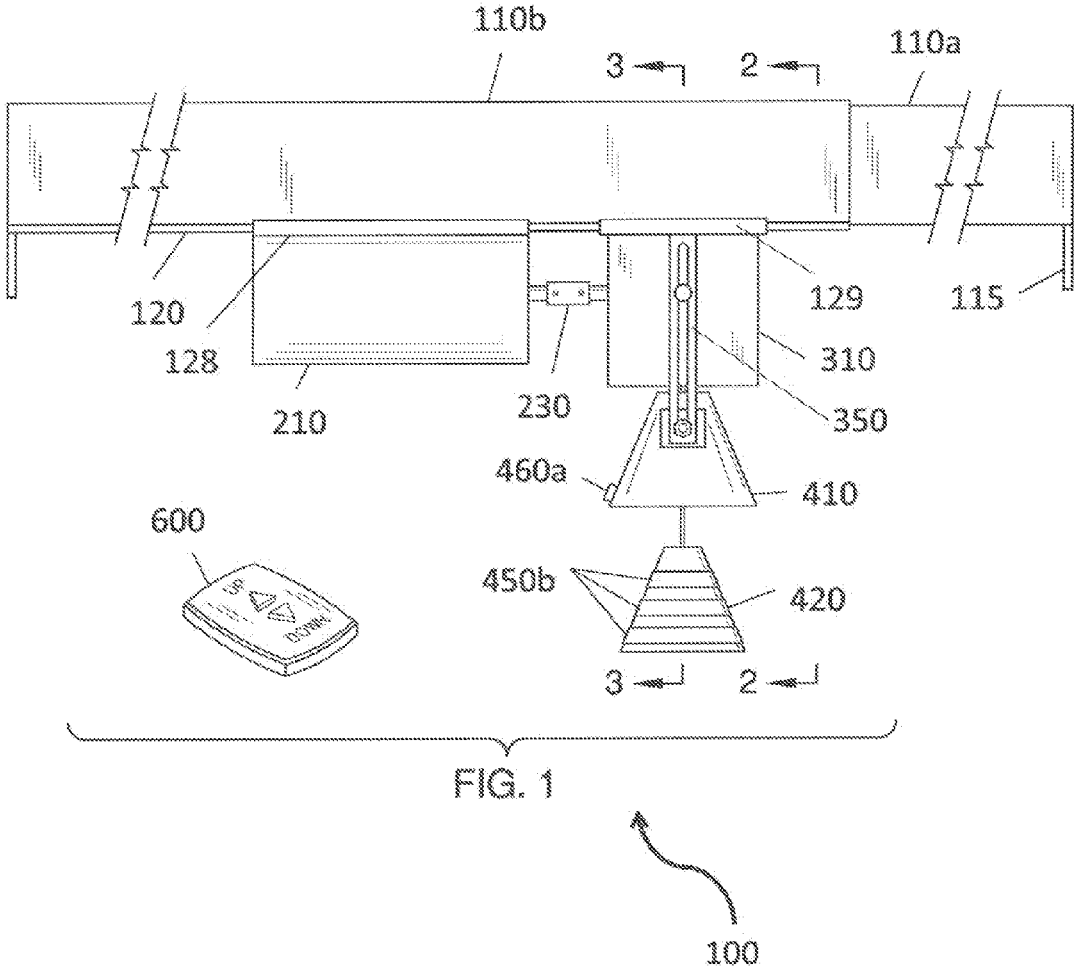
FIG. 1 is a front view of the system of the present invention.
Figure 2:
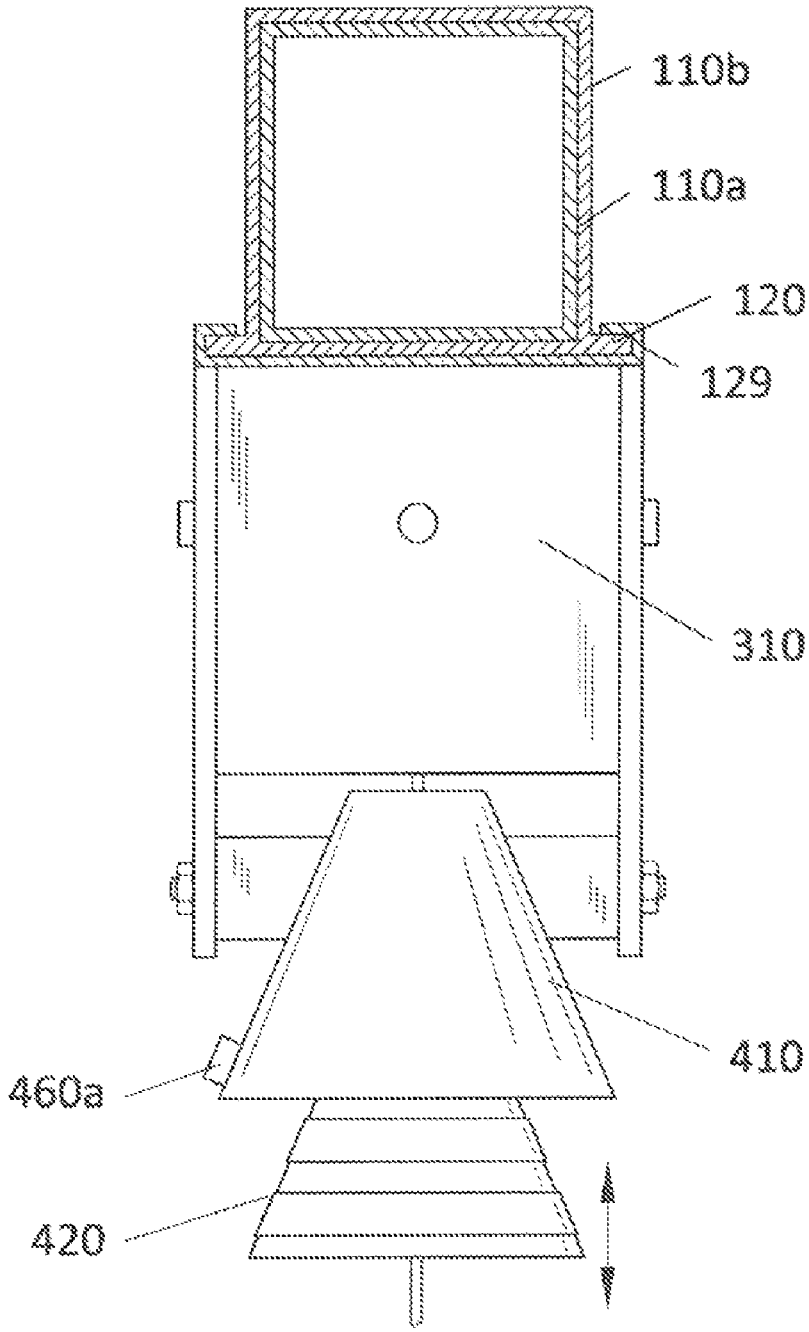
FIG. 2 is a first side cross sectional view of the system of FIG. 1.
Figure 3:
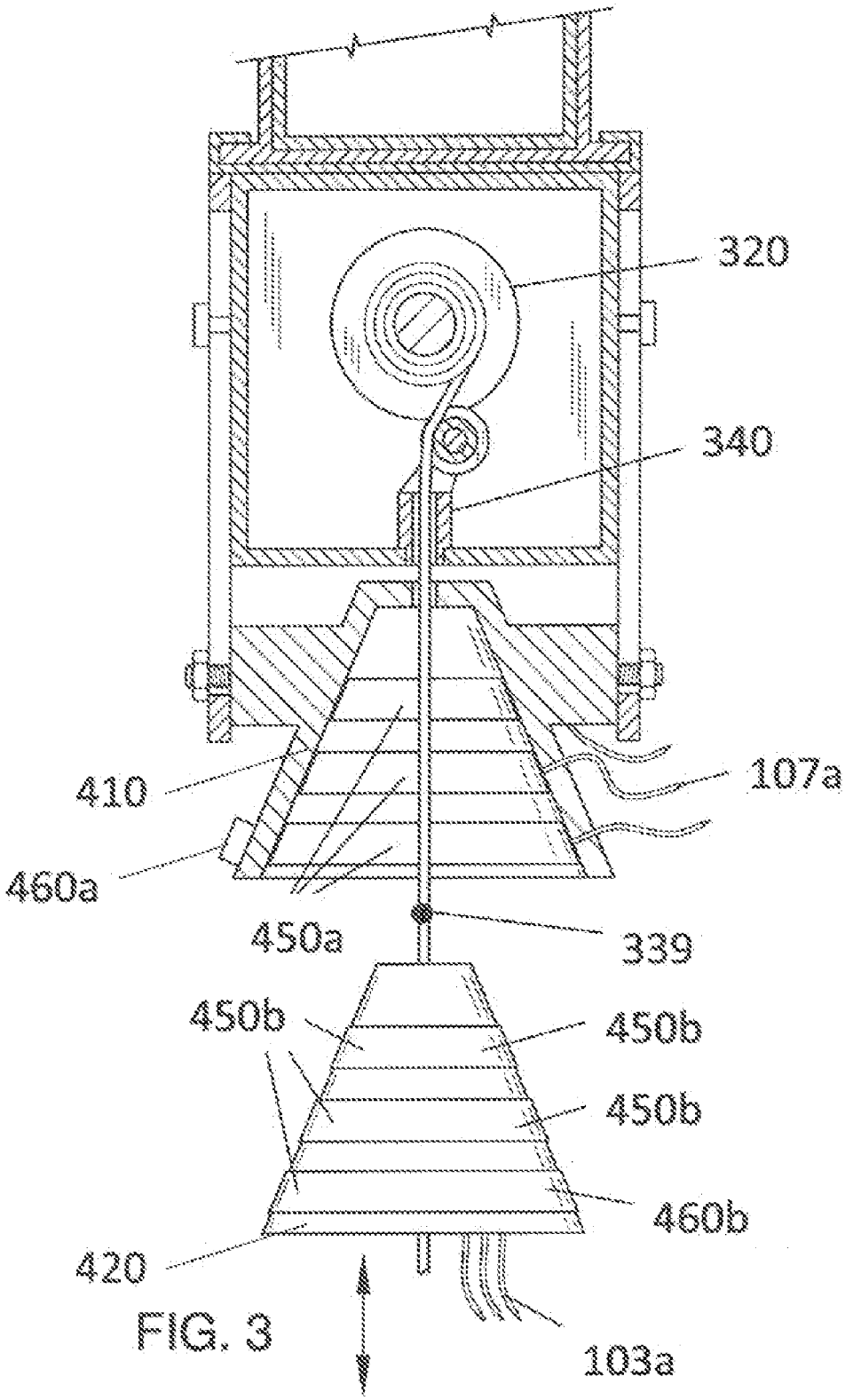
FIG. 3 is a second side cross sectional view of the system of FIG. 1.
Figure 4:
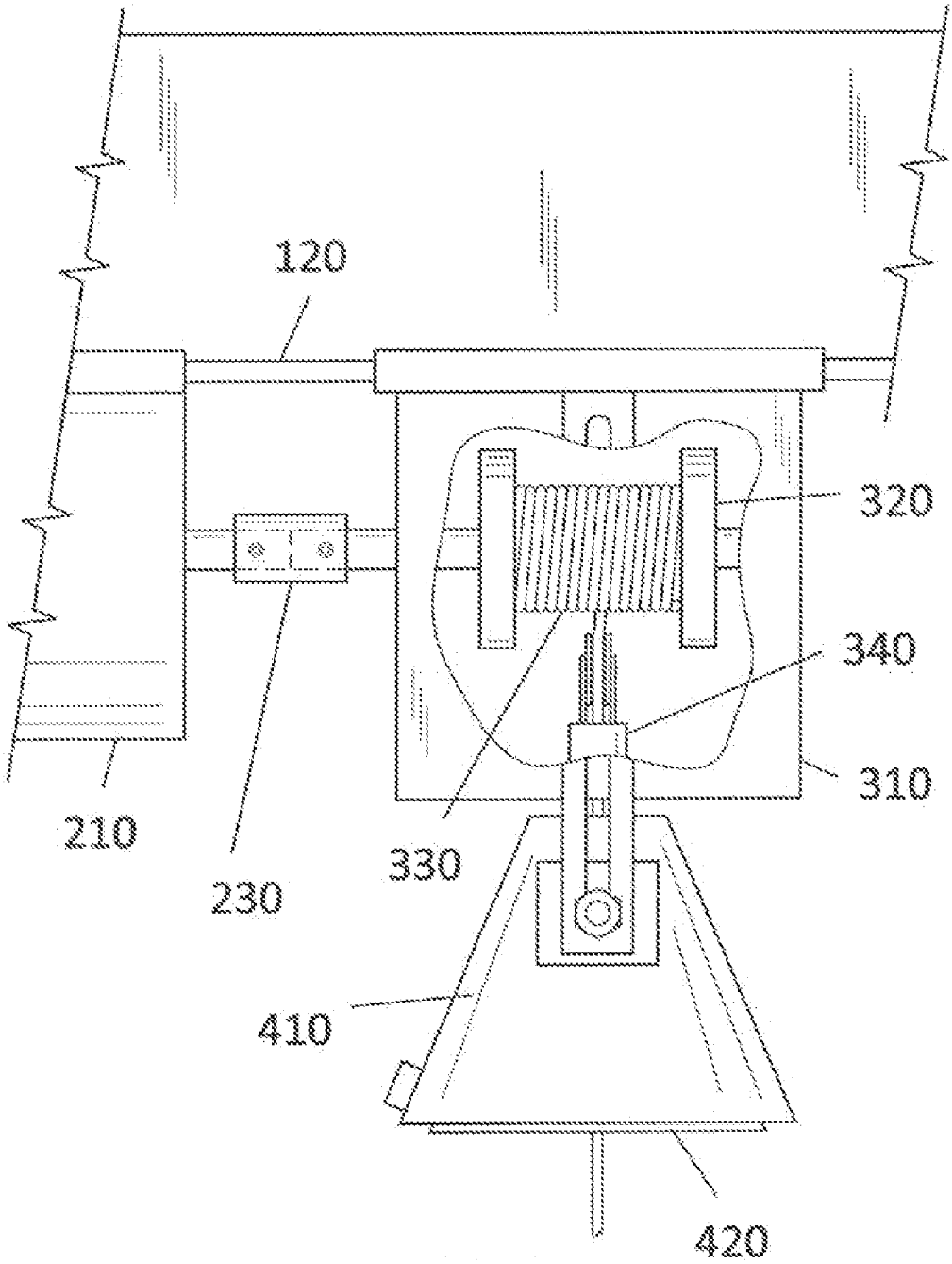
FIG. 4 is a front and internal view of the system of the present invention.
Figure 5:
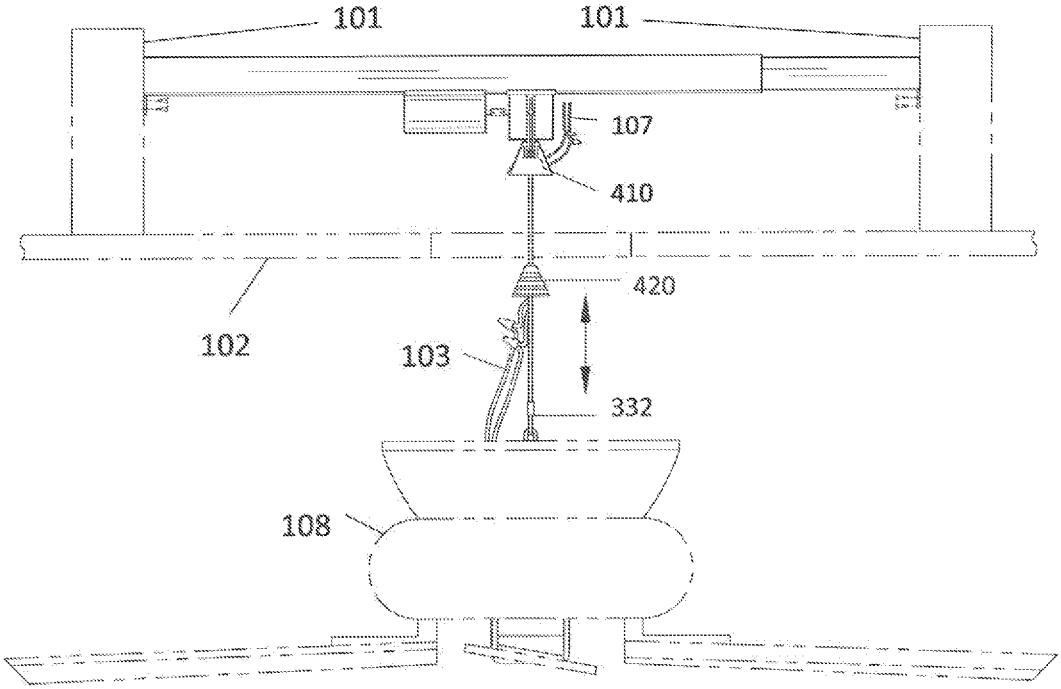
FIG. 5 is an in-use view of the system of the present invention.

The system 100 of the present invention comprises a mounting rail for mounting in between joists 101 of a ceiling 102 (e.g., see FIG. 5 showing a ceiling fan 108 mounted to the ceiling 102 with the system 100 of the present invention). The mounting rail comprises a first telescopic rail 110*a* (e.g., male rail) and a second telescopic rail (e.g., female rail) 110*b*. The first telescopic rail 110*a* is telescopically received in the second telescopic rail 110*b*. The mounting rail is adjustable in length (e.g., to accommodate joists that vary in separation distance), for example the first telescopic rail 110*a* can be slid in and out within the second telescopic rail 110*b*. Telescopic mechanisms are well known to one of ordinary skill in the art. In some embodiments, one or more mounting tabs 115 are disposed on the outer ends of the telescopic rails 110. The mounting tabs 115 allow for attachment of the telescopic rails 110 to the joists 101 (e.g., see FIG. 5) in the ceiling 102 (e.g., via screws, etc.). For example the mounting tabs 115 can mount to the inside of the joist 101 or lap over and mount on the outside of the joist 101. In some embodiments, a rail track 120 is disposed on the bottom surface of the second telescopic rail 110*b* (e.g., to slidably mount the motor and reel box).

Disposed on the second telescopic rail 110*b*, for example slidably disposed on the rail track 120 on the second telescopic rail 110*b*, is a motor 210. In some embodiments, a motor flange 128 (e.g., a U-channel flange) is disposed on the top surface of the motor 210, which engages the rail track 120 on the second telescopic rail 110*b*. The motor 210 may slide along the length of the second telescopic rail 110*b* (e.g., along the rail track 120).

Disposed on the second telescopic rail 110*b*, for example slidably disposed on the rail track 120 on the second telescopic rail 110*b*, is a reel box 310. In some embodiments, a reel box flange 129 (e.g., a U-channel flange) is disposed on the top surface of the reel box 310, which engages the rail track 120 on the second telescopic rail 110*b*. The reel box 310 may slide along the length of the second telescopic rail 110*b* (e.g., along the rail track 120).

The motor 210 is operatively connected to a cable reel 320 disposed in the reel box 310 via a coupling 230. The motor 210 functions to rotate the cable reel 320 in a first direction and a second direction (e.g., effectively moving the fan or light fixture upwardly toward the ceiling 102 and downwardly toward the ground surface). A cable 330 (e.g., steel wire cable) is wrapped around the cable reel 320. Cables and cable reels are well known to one of ordinary skill in the art. The first end of the cable 330 is secured to the cable reel 320. The second end 332 of the cable 330 extends downwardly out of the bottom of the reel box 310. The second end 332 of the cable 330 is attached to the fan or light fixture (e.g., see FIG. 5). The cable 330 functions to raise and lower the fan or light fixture (e.g., via the motor 210, cable reel 320, etc.).

In some embodiments, a cable stop 339 is disposed on the cable 330. The cable stop 339 may be constructed in a variety of shapes (e.g., including but not limited to football-shaped) and from a variety of materials (e.g., including but not limited to metal, for example steel or other durable material). The placement of the cable stop 339 can be adjusted. The cable stop 339 can engage a first micro switch (e.g., disposed in the reel box 310, for example on the swivel pulley 340). When the cable stop 339 engages the first micro switch 460*a*, the micro switch causes the motor 210 from rotating the cable reel 230 in that direction any further. For example, an installer can determine how much length of the cable is needed to lower the fixture to the floor and can set the cable stop 339 to cause the motor to stop at that length.

Disposed in the reel box 310 (e.g., in the inner cavity at the bottom of the reel box 310) is a swivel pulley 340. The swivel pulley 430 engages the cable 330. In some embodiments, the swivel pulley 340 functions to allow an even winding and unwinding of the cable 330 and to direct the cable 330 through the bottom of the reel box 310, for example through a cable aperture disposed in the bottom of the reel box 310. A first micro switch 460*a* may be disposed in the reel box 310, for example on the swivel pulley 340. When the cable stop 339 engages/touches the first micro switch 460*a*, the motor 210 is signaled to stop rotating the cable reel any further in that direction.

A female cone 410 is positioned below the reel box 310 and is connected to the reel box 410 via an attachment means. The female cone 410 is generally hollow (e.g., having an inner cavity) and has a first end and a second end (e.g., an open second end), the first end being the end with the smaller diameter. The first end faces the reel box 310. In some embodiments, the attachment means includes a pair of slide rails 350 (e.g., shafts with a center slot) that are attached to the sides of the reel box 310 and extend downwardly below the bottom surface of the reel box 310, wherein the female cone 410 is attached to the slide rails 350. In some embodiments, the slide rails 350 allow the position of the female cone 410 to be adjusted (e.g., the female cone 410 can be moved toward or away from the reel box 310, for example the female cone 410 can be adjusted to be flush with the ceiling sheet rock). For example, bolts connected to the female cone 410 may slide up and down within the slot of the slide rails 350. The attachment means is not limited to a slide rail mechanism.

The cable 330 passes through a first cone channel disposed in the first end of the female cone 410 and further through the open second end of the female cone 410.

Attached to the cable 330 below the female cone 410 is a male cone 420. The male cone 420 has a first end and a second end, the first end being the end with the smaller diameter. The first end faces the female cone 410. The male cone 420 is adapted to snugly fit inside the inner cavity of the female cone 410 (e.g., see FIG. 2 wherein the male cone 420 is partially in the inner cavity of the female cone 410 and FIG. 4 wherein the male cone 420 is fully in the inner cavity of the female cone 410). The male cone and cable can pass through a ceiling aperture to access the fan or light fixture (see FIG. 5).

Disposed on the inner surface of the female cone 410 is a plurality of first electrical contact rings 450*a*. Disposed on the outer surface of the male cone 420 is a plurality of second electrical contact rings 450*b*. When the male cone 420 is snugly housed in the female cone 410, the electrical contacts 450 contact each other. The house wiring 107 is operatively connected to the first electrical contacts 450*a* of the female cone 410 via first wires 107*a* and the fan wiring 103 is operatively connected to the second contacts 450*b* of the male cone 420 via second wires 107*b*.

Without wishing to limit the present invention to any theory or mechanism, it is believed that the female cone 410 and male cone 420 are advantageous because they allow for the electricity to be cut off from the fan or light fixture when the fan or fixture is lowered. For example, the fan or fixture is operatively connected to the second electrical contact rings of the male cone 420, and the house wiring is connected to the first electrical contact rings female cone 410. Only when the electrical contact rings of the male cone 420 and female cone 410 are in contact does electricity pass to the fan or fixture. Also, even if there is some movement by the fan or fixture, the cones 410, 420 help the contacts line up properly.

In some embodiments, the male cone 420 comprises a sleeve adapted to receive the pipe from the fan (or fixture). The pipe may be fastened via a cotter pin, for example. The sleeve does not necessarily have a threaded hole in the top for the purpose of screwing in the bolt that comes with the light fixture. For example, if a user has a pre-threaded hole he/she can screw a bolt in and tighten it with nuts on the bottom side. In some embodiments, the sleeve can also be manufactured with slots in it. Optionally the sleeve can use a V hook (e.g., metal or plastic). The V hook may hook onto light fixture chain. In some embodiments, additional Vs are disposed on the wide ends of the V hook, which hook into manufactured holes in the sleeve.

In some embodiments, the system 100 further comprises a second micro switch 460*b* disposed on the cones 410, 420, for example a first half switch is a contact ring disposed on the inner surface of the female cone 410 and a second half switch is a contact ring disposed on the outer surface of the male cone 420, wherein when the first half switch contacts the second half switch the motor is signaled to stop rotating the cable reel. This can help prevent the motor from trying to draw in the fan fixture too high.

Figure 6:
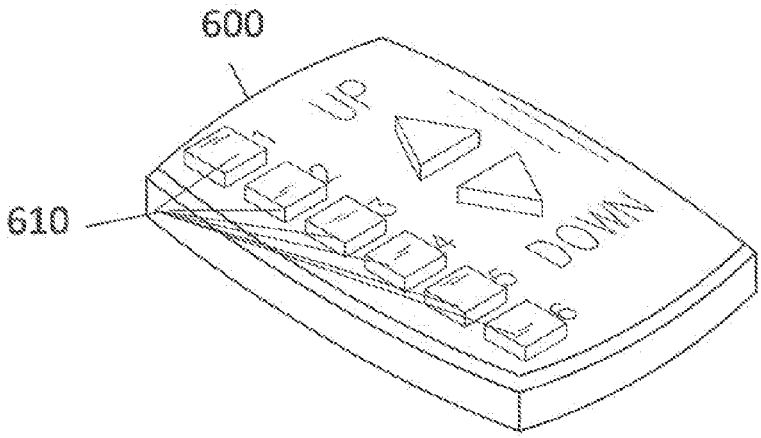
FIG. 6 is a perspective view of the remote control of the system of the present invention. The remote control can control multiple different systems.

In some embodiments, the system 100 further comprises a remote control 600 for controlling the motor. For example, a transmitter is disposed in the remote control 600, which can communicate with a receiver operatively connected to the motor 210. When a first button is pressed on the remote control 600, the motor 210 rotates the cable reel in the first direction to move the fan or light fixture down towards the ground surface. The motor stops when the first micro switch is activated by the cable stop. When a second button is pressed on the remote control 600, the motor 210 rotates the cable reel in the second direction to move the fan or light back towards the ceiling. The motor stops when the second micro switch is activated. In some embodiments, the remote control 600 is housed in a locked box or requires a code to operate. In some embodiments, the remote control 600 is configured to control multiple fans or fixtures either independently of each other or together. For example, as shown in FIG. 6, the remote control 600 may comprise a plurality of unit buttons 610, which control different fans or fixtures.

If the fixture is mounted on an angled ceiling, a user may need an arm (e.g., a swivel arm) to accommodate the angle so that the cones are pointing straight downwardly.

Alternatively to using a micro switch to lock the unit in place when in the home position (at the ceiling), a lock with a lever can be used. For example, the lever may extend across the bottom of the cone to hold the cone in place. A lock may be attached to the top cone and bottom cone. Alternatively, electromagnetic circular contactors can be used in the cones.

In some embodiments, the reel is spring-loaded as a safety feature, which may help prevent a free fall drop of the unit.

The disclosures of the following U.S. patents are incorporated in their entirety by reference herein: U.S. Pat. No. 6,443,702; U.S. Pat. No. 5,556,195; U.S. Pat. No. 5,105,349; U.S. Pat. No. 4,316,238; U.S. Pat. No. 6,520,484; U.S. Pat. No. 7,160,148; U.S. Design Pat. No. D246,286.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A system for raising and lowering a ceiling fixture, said system comprising:

(a) a mounting rail for mounting in between joists 101 of a ceiling 102, the mounting rail comprises a first telescopic rail 110*a* and a second telescopic rail 110*b*, the first telescopic rail 110*a* is telescopically received in the second telescopic rail 110*b;*

(b) a rail track 120 disposed on a bottom surface of the second telescopic rail 110*b;*

(c) a reel box 310 slidably disposed on the rail track 120 via a reel box flange 129, wherein a cable reel 320 is disposed in the reel box 310 and a cable 330 is wrapped around the cable reel 320, a second end 332 of the cable 330 extends downwardly out of a bottom of the reel box 310, the second end 332 of the cable 330 is for attaching to a ceiling fixture;

(d) a motor 210 slidably disposed on the rail track 120 via a motor flange 128, the motor 210 is operatively connected to the cable reel 320 via a coupling 230, the motor 210 functions to rotate the cable reel 320 in a first direction and a second direction effectively moving ceiling fixture attached to the second end 332 of the cable 330 upwardly toward the ceiling 102 and downwardly toward a ground surface, respectively;

(e) a female cone 410 positioned below the reel box 310 and connected to the reel box 410 via an attachment means, the female cone 410 is generally hollow with an inner cavity, a first end, and a second end, the second end being open, the first end having a smaller diameter compared to the second end, the first end faces the reel box 310, the cable 330 passes through the first end of the female cone 410 and further through the second end of the female cone 410;

(f) a male cone 420 attached to the cable 330 near the second end 332, the male cone 420 is positioned below the female cone 410, the male cone 420 has a first end and a second end, the first end having a smaller diameter compared to the second end, the first end faces the female cone 410, the male cone 420 is adapted to snugly fit inside the inner cavity of the female cone 410;

(g) a first electrical contact ring 450*a* disposed on an inner surface of the female cone 410 and a second electrical contact ring 450*b* disposed on an outer surface of the male cone 420, the first electrical contact ring 450*a* is adapted to be operatively connected to house wiring and the second electrical contact ring 450*b* is adapted to be operatively connected to wiring of the ceiling fixture, the electrical contact rings 450 operatively connect when the male cone 420 is snugly housed in the female cone 410;

(h) a swivel pulley 340 disposed in the reel box 310, the swivel pulley 340 engages the cable 330, the swivel pulley 340 functions to direct the cable 330 through the bottom of the reel box 310; and (i) either (1) a first micro switch 460*a* is disposed on the swivel pulley 340 and a cable stop 339 disposed on the cable 330 between the swivel pulley 340 and the male cone 420, the cable stop 339 is adapted to activate the first micro switch 460*a* of the swivel pulley 340 when the cable 330 is rotated in the first direction such that the cable stop 339 engages the first micro switch 460*a*, when the first micro switch 460*a* is activated the first micro switch 460*a* causes the motor 210 to stop rotating the cable 230 reel in the first direction; or (2) a second micro switch 460*b* comprising a first half switch disposed on the inner surface of the female cone 410 and a second half switch disposed on the outer surface of the male cone 420, the second micro switch 460*b* is activated when the first half switch engages the second half switch, when the second micro switch 460*b* is activated the second micro switch 460*b* causes the motor 210 to stop rotating the cable 230 reel in the first direction.

2. The system of claim 1, wherein a mounting tab 115 is disposed on an outer ends the first telescopic rail 110*a* or the second telescopic rail 110*b*, the mounting tabs 115 allow for attachment of the respective telescopic rails 110 to joists 101 in a ceiling 102.

3. The system of claim 1, wherein the motor flange 128 is a U-channel flange.

4. The system of claim 1, wherein the reel box flange 129 is a U-channel flange.

5. The system of claim 1, wherein the cable stop 339 is constructed in a football-shape.

6. The system of claim 1, wherein the placement of the cable stop 339 is adjustable.

7. The system of claim 1, wherein the attachment means is a pair of slide rails 350 attached to sides of the reel box 310, the slide rails 350 allow positioning of the female cone 410 to be adjusted.

8. The system of claim 7, wherein the slide rails 350 each comprise a shaft with a center slot.

9. The system of claim 8, wherein bolts connect the female cone 410 to the center slots of the slide rails 350, the bolts can slide up and down within the center slots of the slide rails 350.

10. The system of claim 1, wherein the cable 330 passes through a first cone channel disposed in the first end of the female cone 410 and further through the open second end of the female cone 410.

11. The system of claim 1, wherein the system comprises both the first micro switch 460*a* and the second micro switch 460*b*.

12. The system of claim 1 further comprising a remote control 600 functioning to remotely control the motor 210, the remote control 600 functions to cause the motor 210 to rotate the cable reel 230 in the first direction or the second direction.

* * * * *